US006388858B1

(12) United States Patent
Simms et al.

(10) Patent No.: US 6,388,858 B1
(45) Date of Patent: May 14, 2002

(54) REMOTELY CONTROLLABLE CIRCUIT BREAKER

(75) Inventors: Kevin Anthony Simms, Library; Wayne Gerald Adamson, Coraopolis, both of PA (US); David Lee Davidson, Camden, SC (US); Kenneth L. Uhlman, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/514,458

(22) Filed: Feb. 28, 2000

(51) Int. Cl.[7] ..... H01H 73/00
(52) U.S. Cl. ..... 361/115; 335/14
(58) Field of Search ..... 361/54, 102, 114, 361/115; 335/14, 20

(56) References Cited

U.S. PATENT DOCUMENTS 5,301,083 A 4/1994 Grass et al. ..... 361/64
5,373,411 A 12/1994 Grass et al. ..... 361/64
5,633,776 A 5/1997 Juncu et al. ..... 361/115

*Primary Examiner*—Ronald W. Leja
(74) *Attorney, Agent, or Firm*—Martin J. Moran

(57) ABSTRACT

A circuit breaker has a set of remotely controllable secondary contacts connected in series with the main contacts which provide overcurrent protection. The secondary contacts are opened and closed by a latching solenoid having a close coil and an open coil which are separately connected to switched terminals of a first switch. A voltage source, which may be ac, dc or pulsed, is connected to the common terminal of the first switch through a rectifier. The first switch is coupled to the plunger of the latching solenoid which opens and closes the set of secondary contacts and enables the coil which operates the set of secondary contacts to the opposite state. Energization of the enabled coil is completed by additional, remotely located switches connected between each coil and ground. A status line connected to one of the switched terminals of the first switch is energized when the associated coil is enabled to indicate the open/close status of the set of secondary contacts.

10 Claims, 3 Drawing Sheets

REMOTELY CONTROLLABLE CIRCUIT BREAKER

RELATED APPLICATION

Commonly owned, concurrently filed application entitled "A Remotely Controllable Circuit Breaker With Combined Visual Indication of State and Manual Override" and identified by Ser. No. 09/514,103.

BACKGROUND OF THE INVENTION

1. Field of the Invention

This invention relates to circuit breakers for protecting electric power circuits. More particularly, it relates to circuit breakers with a set of secondary contacts which can be remotely controlled by a latchable operator such as a magnetically latchable solenoid.

2. Background Information

Circuit breakers used in residential and light commercial applications are commonly referred to as miniature circuit breakers because of their limited size. Such circuit breakers typically have a pair of separable contacts opened and closed by a spring biased operating mechanism. A thermal-magnetic trip device actuates the operating mechanism to open the separable contacts in response to persistent overcurrent conditions and to short circuits. Usually, circuit breakers of this type for multiple circuits within the residence or commercial structure are mounted together within a load center which may be located in a basement or other remote location. In some applications, it has been found convenient to use the circuit breakers for other purposes than just protection, for instance, for load shedding. It is desirable to be able to perform this function remotely, and even automatically, such as with a computer. However, the spring powered operating mechanisms are designed for manual reclosure and are not easily adapted for reclosing remotely. In any event, the mechanisms are not designed for repeated operation over an extended period of time.

U.S. Pat. Nos. 5,301,083 and 5,373,411 describe a remotely operated circuit breaker which introduces a second pair of contacts in series with the main separable contacts. The main contacts still interrupt the overcurrent, while the secondary contacts perform the discretionary switching operations. The secondary contacts are controlled by a solenoid which is spring biased to close the contacts. The solenoid has two coils, an opening coil and a hold coil. Initially, both coils are energized to open the contacts. Power to the opening coil is then turned off, and only the holding coil remains energized. Thus, continuous power is required to keep the main contacts open. When power to the holding relay is terminated, the spring recloses the secondary contacts.

There is a need, therefore, for an improved remotely operated circuit breaker.

More particularly, there is a need for such a remotely controllable circuit breaker which does not require continuous power to maintain the contacts in either an open or closed state.

There is a further need for such a remotely controllable circuit breaker which is simple and economical.

There is still another need for such a remotely controllable circuit breaker which provides an indication of the status of the remotely controllable set of contacts.

SUMMARY OF THE INVENTION

These needs and others are satisfied by the invention which is directed to a remotely controllable circuit breaker which includes a latching solenoid to open and close the remotely controllable secondary contacts. The solenoid has a first coil which when energized operates the solenoid's plunger to a first position which closes the set of secondary contacts and a second coil which when energized operates the plunger to a second position in which the set of secondary contacts is opened. A control circuit includes a voltage source and a first switch which selectively connects the voltage source to the first or second coil. This first switch has a common terminal to which the voltage source is connected. A first switched terminal and a second switched terminal on this first switch are alternatively selectively connected to the common terminal. The first coil of the solenoid is connected between the first switched terminal and ground through a second, remotely controlled switch. Similarly, the second coil is connected between the second switched terminal and ground also preferably through a third switch. The first switch is coupled to the plunger of the solenoid and has first contacts connected between the common terminal and the first switched terminal and second contacts connected between the second switched terminal and the common terminal. One of these contacts is normally open and the other is normally closed. These contacts in the first switch enable one of the coils of the solenoid or the other by connecting it to the voltage source. Actuation of the coil is then initiated by closure of the remotely located second or third switch. The status line is connected to one of the switched terminals so that it is energized by the single voltage source when the associated coil is enabled.

A principal object of the invention is to provide a remotely controllable circuit breaker in which the set of secondary contacts is opened and closed by momentary remotely generated signals so that continuous power is not needed to maintain the contacts in one state or the other.

It is also an object of the invention to provide such a remotely controllable circuit breaker in which the control circuitry is simple and economical to implement.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
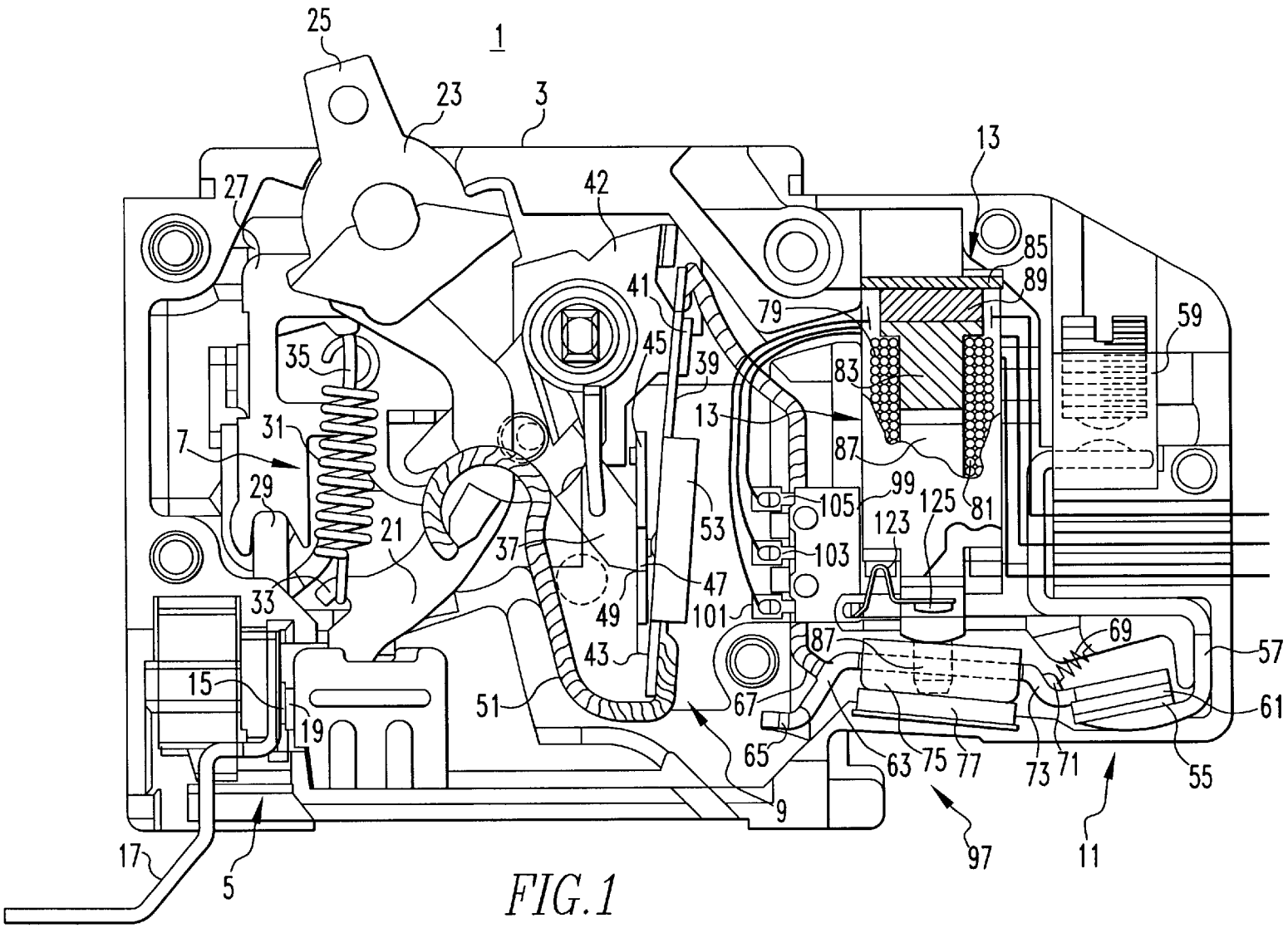
FIG. 1 is an elevational view of a remotely controllable circuit breaker in accordance with the invention shown with the cover removed and with the main contacts and secondary contacts closed.
Figure 2:
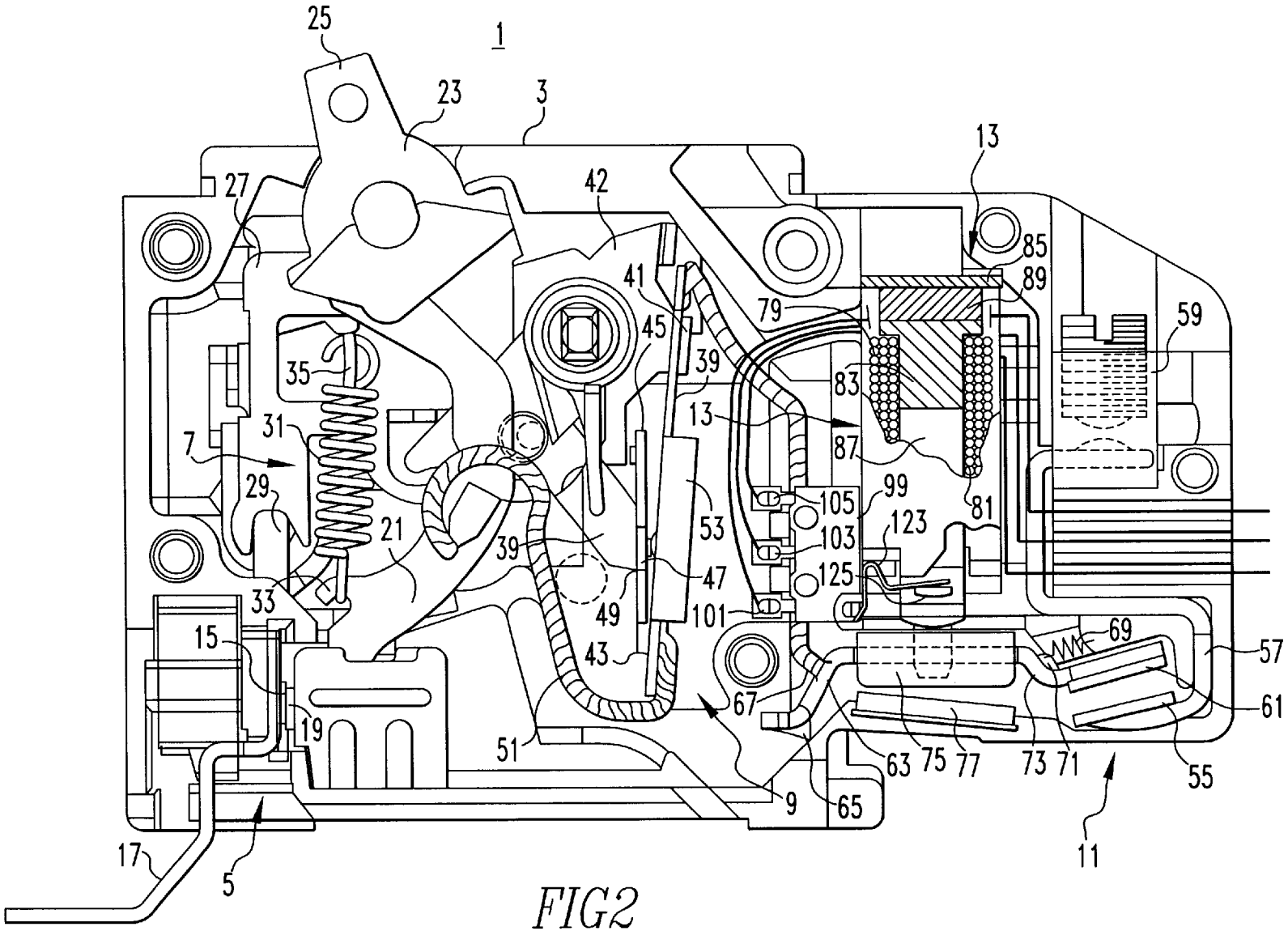
FIG. 2 is a view similar to that of FIG. 1 with the secondary contacts open.

The invention will be described as applied to a miniature circuit breaker, although it will become apparent that it could be applied to other types of circuit breakers as well. Such a miniature circuit breaker 1 includes a molded housing 3 and is shown in FIGS. 1 and 2 with the cover of the housing removed. The basic components of the circuit breaker 1 are a set of main contacts 5, an operating mechanism 7 for opening the set of main contacts 5, and a thermal-magnetic trip device 9 which actuates the operating mechanism to trip the set of main contacts 5 open in response to certain overcurrent conditions. Further included are a set of secondary contacts 11 and an actuator 13 in the form of a magnetically latchable solenoid 13 which is remotely controllable to control the open and closed states of the set of secondary contacts 11.

The set of main contacts 5 includes a fixed contact 15 secured to a line terminal 17 and a moveable main contact 19 which is affixed to an arcuate 7 contact arm 21 which forms part of the operating mechanism 7. The operating mechanism 7 is a well-known device which includes a pivotally mounted operator 23 with an integrally molded handle 25. The operating mechanism also includes a cradle 27 pivotally mounted on a support 29 molded in the housing. With the handle 25 in the closed position, as shown in FIGS. 1 and 2, a spring 31 connected to a hook 33 on the contact arm 21 and a tab 35 on the cradle 27 holds the main contacts 5 closed. The spring 31 also applies a force with the set of main contacts 5 closed, as shown, to the cradle 27 which tends to rotate the cradle in a clockwise direction about the support 29. However, the cradle has a finger 37 which is engaged by the thermal-magnetic trip device 9 to prevent this clockwise rotation of the cradle under normal operating conditions.

The thermal-magnetic trip device 9 includes an elongated bimetal 39 which is fixed at its upper end to a tab 41 on the metal frame 42 seated in the molded housing 3. Attached to the lower, free end of the bimetal 39 by a lead spring 43 is an armature 45. The armature 45 has an opening 47 which is engaged by a latching surface 49 on the finger 37.

The free end of the bimetal 39 is connected to the contact arm 21 by a flexible braided conductor 51 so that the load current of the circuit protected by the circuit breaker 1 passes through the bimetal. A persistent overcurrent heats the bimetal, which causes the lower end to move to the right, as shown in FIGS. 1 and 2. If this overcurrent is of sufficient magnitude and duration, the latching surface 49 on the finger 37 is pulled out of engagement with the armature 45. This allows the cradle 27 to be rotated clockwise by the spring 31. The clockwise rotation of the cradle 27 moves the upper pivot point for the contact arm across the line of force of the spring 31 so that the contact arm is rotated counterclockwise, to open the set of main contacts (not shown), as is well understood. This also results in the handle 25 rotating to an intermediate position to indicate the tripped condition of the set of main contacts 5.

In addition to the armature 45, a magnetic pole piece 53 is supported by the bimetal 39. Very high overcurrents, such as those associated with a short circuit, produce a magnetic field which draws the armature 45 to the pull piece 53, thereby also releasing the cradle 27 and tripping the set of main contacts 5 open. Following either trip, the main set of contacts 5 are reclosed by moving the handle 25 fully clockwise, which rotates the cradle 27 counterclockwise until the finger 37 relatches in the opening 47 in the armature 45. Upon release of the handle, it moves counterclockwise slightly from the full clockwise position and remains there. With the cradle relatched, the line of force of the spring 31 is reestablished to rotate the contact arm 21 clockwise to close the set of main contacts 5 when the handle 25 is rotated fully counterclockwise to the position shown in FIGS. 1 and 2.

The set of secondary contacts 11 includes a fixed secondary contact 55 which is secured on a load conductor 57 which leads to a load terminal 59. The set of secondary contacts 11 also includes a moveable secondary contact 61 which is fixed to a secondary contact arm 63 which at is opposite end is seated in a molded pocket 65 in the molded housing 3. The secondary contact arm 63 is electrically connected in series with the set of main contacts 5 by a second flexible braided conductor 67 connected to the fixed end of the bimetal 39. Thus, a circuit or load current is established from the line terminal 17 through the set of main contacts 5, the contact arm 21, the flexible braided conductor 51, the bimetal 39, the second flexible braided conductor 67, the secondary contact arm 63, the set of secondary contacts 11, the load conductor 57 to the load terminal 59.

The set of secondary contacts 11 is biased to the closed state shown in FIG. 1 by a helical compression spring 69 seated on a projection 71 on an offset 73 in the secondary contact arm 63. As discussed in U.S. Pat. No. 5,301,083, the spring 69 is oriented such that the force that it applies to the secondary contact arm 63 tending to close the set of secondary contacts is relaxed to a degree with the set of secondary contacts in the open position. This serves the dual purpose of providing the force needed to close the set of secondary contacts against rated current in the protected circuit and also reducing the force that must be generated by the magnetically latching solenoid 13 to hold the set of secondary contacts in the open state. In order for the set of secondary contacts 55 to withstand short circuit currents and allow the set of main contacts 5 to perform the interruption, the magnet force generated by the short circuit current causes an armature 75 mounted on the secondary contact arm 63 to be attracted to a pole piece 77 seated in the molded housing thereby clamping the secondary contacts closed.

As shown by the partial sections in FIGS. 1 and 2, the actuator/solenoid 13 includes a first or close coil 79 and a second or open coil 81 concentrically wound on a steel core 83 supported by a steel frame 85. A plunger 87 moves rectilinearly within the coils 79 and 81. A permanent magnet 89 is seated between the steel core 83 and the steel frame 85.

The plunger 87 engages the secondary contact arm 63. When the close coil 79 is energized, a magnetic field is produced which drives the plunger downward to a first position which rotates the secondary contact arm 63 clockwise and thereby moves the set of secondary contacts 11 to the closed state. The secondary contacts 11 are maintained in the closed state by the spring 69. When it is desired to open the set of secondary contacts 11, the open coil 81 is energized which lifts the plunger 87 and with it the secondary contact arm 63 to a second position which opens the set of secondary contacts 11. With the plunger 87 in the full upward position as shown in FIG. 2, it contacts the steel core 83 and is retained in this second position by the permanent magnet 89. Subsequently, when the close coil 79 is energized, the magnetic field generated is stronger than the field generated by the permanent magnet and therefore overrides the latter and moves the plunger 87 back to the first, or closed position.

Figure 3:
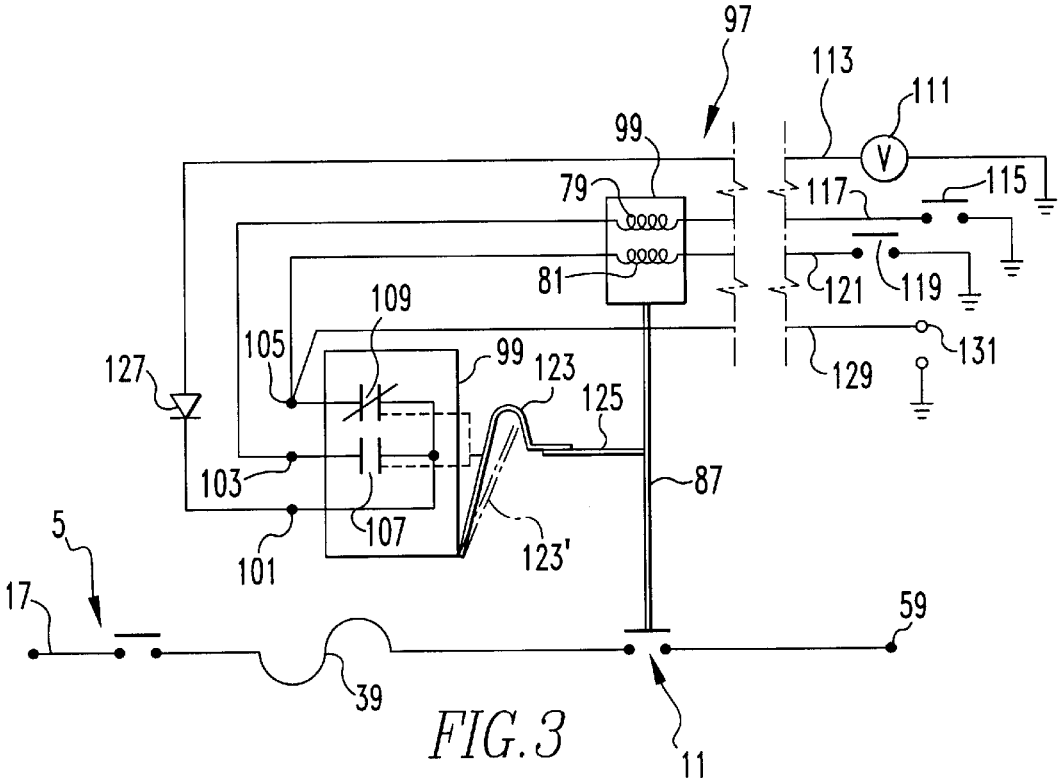
FIG. 3 is a schematic circuit diagram of the control circuit for the remotely controllable circuit breaker shown in FIGS. 1 and 2.

The first and second or close and open coils 79, 81 of the magnetically latching solenoid 13 are remotely controlled by a control circuit 97 which is best seen in FIG. 3. This control circuit 97 includes a first switch or internal power cutoff device in the form of microswitch 99 which has a common terminal 101 and first and second switched terminals 103, 105. The microswitch 99 includes first contacts 107 connected between the common terminal and the first switched terminal 103, and second contacts 109 connected between the common terminal 101 and the second switched terminal 105. In the form of the circuit shown, the first contacts 109 of the microswitch are normally open contacts and the second contacts are normally closed contacts. The common terminal 101 of the microswitch 99 is connected to a remotely located voltage source 111 through a lead 113. The first or close coil 79 of the solenoid 13 is connected between the first switched terminal 103 of the microswitch 99 and a remotely located second or close switch 115 through a lead 17. The other side of the close switch 115 is connected to ground. Similarly, the second or open coil 81 is connected between the second switched terminal 105 of the microswitch 99 and a third or open switch 119 through lead 121. Again, the other side of the switch 119 is grounded.

Figure 4:
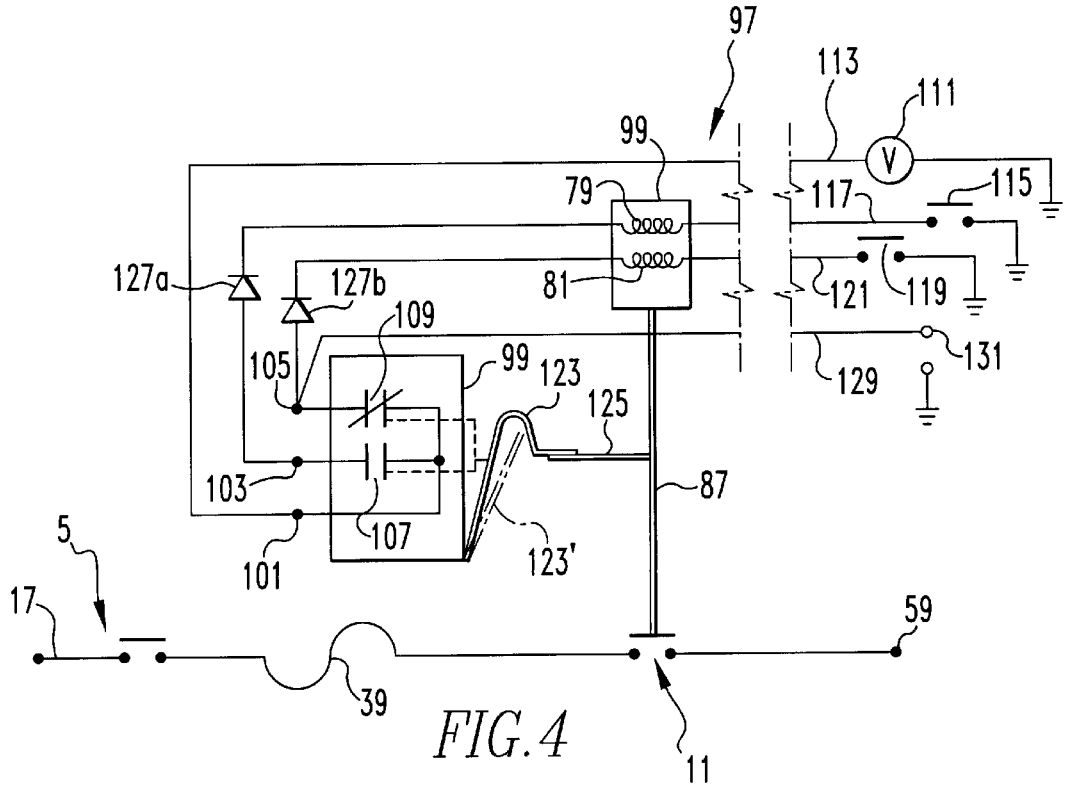
FIG. 4 is a schematic circuit diagram of a modified control circuit.

The microswitch 99 has an operating member in the form of actuating lever 123 which is engaged by a projection 125 on the plunger 87 of the solenoid. When the solenoid is latched is in the upward or second position as shown in FIG. 2 so that the second set of contacts 11 are open, the microswitch 99 is actuated and the first or normally open contacts 107 are closed while the normally closed contacts 109 are open. Thus, the voltage source 111 is connected to enable the close coil 79 so that whenever the remote close switch 115 is closed, the first coil will be energized. A rectifier circuit implemented by diode 127 is provided in the lead 113, or 103 and 105, so that only voltage of the proper polarity can energize the coil 79 to effect downward movement of the plunger 87. Also, with the diode 127 ac voltage as well as dc voltage can be used for the voltage source 111. The diode 127 will provide half wave rectification of any ac signal. Since the solenoid 13 latches in the open and closed positions, only monetary power is needed to open and close the set of secondary contacts 11. This monetary power can be provided by an ac source, a dc source or a pulse source. Alternatively, in place of the single diode 127 in the lead 113, separate similarly polarized diodes can be provided in leads 117 and 121 as shown by the diodes 127*a* and 127*b* in FIG. 4. This modified control circuit operates similarly to the described manner in which the control circuit of FIG. 3 operates.

With energization of the closed coil 79, the plunger is driven downward to its first position which closes the set of secondary contacts 11 and allows the actuating lever 123 of the microswitch 99 to move to the open position shown in phantom in FIG. 3. This results in opening of the normally open contacts 107 and closure of the normally closed contacts 109 to disconnect the voltage source from the close contacts 107. However, the set of second contacts 11 remain latched in the closed position due to the spring 69. With the normally closed contacts 109 now closed, the open coil 81 is enabled by application of the voltage from the voltage source 111. However, no current flows through the open coil 81 until the remote open switch 119 is closed to complete the circuit for the open coil. In order to provide an indication of the status of the set of secondary contacts 11, a status line 129 is connected to the second switched terminal 105 of the microswitch 99, which as mentioned, is hot when the set of secondary contacts 11 are in the closed position and the normally closed contact 109 is closed. The status line 129 therefore provides a voltage signal relative to ground at status terminals 131 which is indicative of the opened/closed state of the set of secondary contacts 11.

Alternatively, the status line 129 can be connected to the terminal 103 if it is desired to have a positive indication of the open state of the set of secondary contacts 11. Further flexibility is available when it is considered that the coupling between the plunger 87 and the microswitch 99 can be arranged so that the actuating lever of switch is operated when the plunger 87 is in the first position and the set of secondary contacts 11 is closed.

As the set of secondary contacts 11 are latched in either the open state or the closed state, it is not necessary to provide continuous power from the voltage source 11 to maintain them in either state. Accordingly, momentary signals can be used to control operation of the solenoid 13. The remote close and open switches 115 and 119 can be manual switches or automatic switches, such as output contacts of a computer system. Similarly, the status terminals 113 can be input terminals on such a computer controlled system. As an alternative arrangement, the open and close switches can be eliminated so that the closed and open coils 79,80 are connected directly between the microswitch terminals and ground. In this arrangement, the position of the plunger is toggled by successive momentary signals generated by the voltage source 111.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A remotely controllable circuit breaker comprising:

a set of main contacts;

an operating mechanism for opening and closing said set of main contacts;

a set of secondary contacts connected in series with said set of main contacts;

a latching solenoid including a plunger latchable to a first position which closes said set of secondary contacts and to a second position which opens said set of secondary contacts, a first coil which when energized operates said plunger to said first position and a second coil which when energized operates said plunger to said second position;

a control circuit comprising;

a voltage source; and a first switch selectively connecting said voltage source to said first coil and to said second coil, wherein said first switch has a common terminal, a first switched terminal selectively connectable to said common terminal and a second switched terminal alternatively selectively connectable to said common terminal, said first coil being connected between said first switched terminal and ground and said second coil being connected between said second switched terminal and ground.

2. The remotely controllable circuit breaker of claim 1 wherein said control circuit further includes a second switch connected in series with said first coil between said first coil and ground, and a third switch connected in series with said second coil between said second coil and ground, said second and third switches being located remotely from said latching solenoid.

3. The remotely controllable circuit breaker of claim 2 wherein said first switch has an operating member coupled to said plunger, first contacts connected between said common terminal and said first switched terminal and second contacts connected between said common terminal and said second switched terminal, said first contacts and second contacts being operated by said operating member with said first contacts being closed when said plunger is in said second position and said second contacts being closed when said plunger is in said first position.

4. The remotely controllable circuit breaker of claim 3 wherein said first switch is a microswitch and one of said first and second contacts connected to said first and second switched terminals is a normally closed contact and the other is a normally open contact.

5. The remotely controllable circuit breaker of claim 4 wherein said control circuit further includes a status line connected to one of said first and second switched terminals connected to said one of said first and second contacts which is normally closed providing a status signal to a remote location by energization of said status line by said voltage source through said normally closed contact.

6. The remotely controllable circuit breaker of claim 4 wherein said operating member is actuated by said plunger when said plunger is in said first position, said one of said first and second contacts is said second contact connected to said second switched terminal and said other is said first contact connected to said first switched terminal.

7. The remotely controllable circuit breaker of claim 6 wherein said control circuit further includes a status line connected to said second switched terminal providing a status signal to a remote location by energization of said status line by said voltage source through said normally closed second contact.

8. The remotely controllable circuit breaker of claim 6 wherein said control circuit further includes a rectifier circuit connected in series with said voltage source and said first and second coils and wherein said voltage source is selected from a group comprising an ac voltage source, a dc voltage source and pulse voltage source.

9. The remotely controllable circuit breaker of claim 8 wherein said rectifier circuit comprises a rectifier connected between said voltage source and said common terminal of said first switch.

10. The remotely controllable circuit breaker of claim 8 wherein said rectifier circuit comprises one rectifier connected between said first switched terminal and ground and another rectifier connected between said second switched terminal and ground.

* * * * *